US006422166B1

(12) United States Patent
Wessel et al.

(10) Patent No.: US 6,422,166 B1
(45) Date of Patent: Jul. 23, 2002

(54) METHOD FOR OPERATING A SEWING DEVICE AND SEWING DEVICE FOR CARRYING OUT THIS METHOD

(75) Inventors: Hans Jürgen Wessel, Bielefeld; Jochen Fischer, Detmold, both of (DE)

(73) Assignee: Durkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 09/857,384

(22) PCT Filed: Apr. 6, 2000

(86) PCT No.: PCT/EP00/03054

§ 371 (c)(1),
(2), (4) Date: Jun. 1, 2001

(87) PCT Pub. No.: WO00/68482

PCT Pub. Date: Nov. 16, 2000

(30) Foreign Application Priority Data

May 6, 1999 (DE) ..... 199 21 017
May 6, 1999 (DE) ..... 299 23 211 U

(51) Int. Cl.[7] ..... D05B 21/00

(52) U.S. Cl. ..... 112/475.04; 112/470.07; 112/315

(58) Field of Search ..... 112/470.07, 470.06, 112/102.5, 103, 475.04, 475.19, 314, 315, 470.04

(56) References Cited

U.S. PATENT DOCUMENTS 4,312,283 A * 1/1982 Fischer et al. ..... 112/470.07 X
4,479,446 A 10/1984 Johnson et al.
4,513,677 A 4/1985 Scholl
4,548,142 A 10/1985 Peck
4,763,586 A * 8/1988 Takenoya et al. ..... 112/103

FOREIGN PATENT DOCUMENTS

DE 90 15 822 7/1991
GB 1 576 506 8/1980

* cited by examiner

*Primary Examiner*—Peter Nerbun
(74) *Attorney, Agent, or Firm*—Robert F I. Conte; Lee, Mann, Smith, McWilliams, Sweeney & Ohlson

(57) ABSTRACT

In a sewing installation comprising a work piece holder of an outer contour that corresponds to the geometry of the work piece to be fixed thereon, the work piece holder being displaceable relative to a sewing needle via a control unit by the aid of x-y-drive motors, it is provided that a storage medium (chip 28) is disposed on the work piece holder (5, 6, 7), comprising any information necessary for the control of the sewing installation so that the course of the seam is computed and sewn corresponding to the contour of the work piece holder (5, 6, 7), the sewing installation comprising a sensor unit (read head 29) designed for the information to be read out of the storage medium (chip 28) and to be fed to an input of the control unit.

8 Claims, 2 Drawing Sheets

Fig. 1
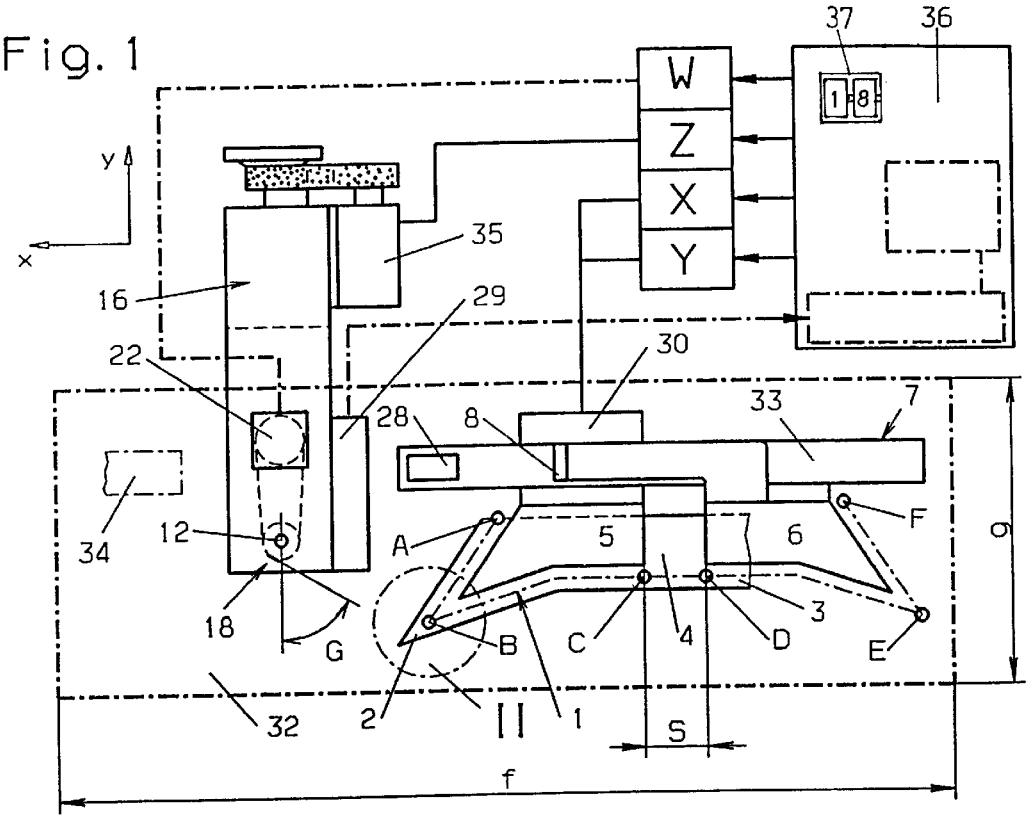
III Fig. 2
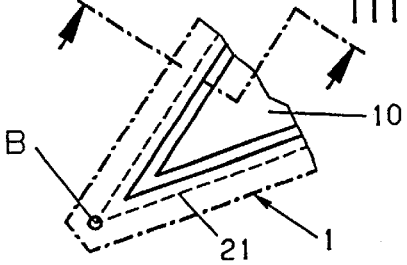
Fig. 3
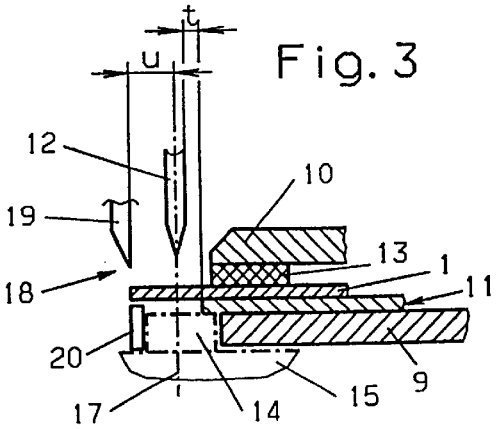
Fig. 5
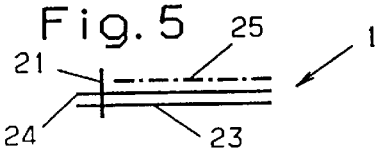
Fig. 6
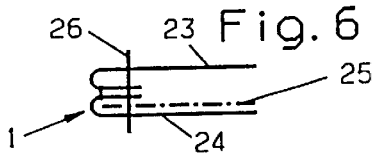
Fig. 4
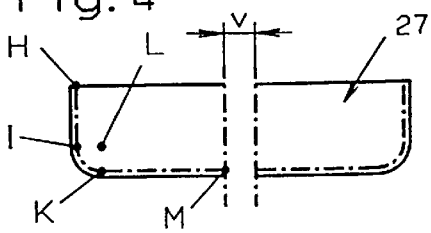

METHOD FOR OPERATING A SEWING DEVICE AND SEWING DEVICE FOR CARRYING OUT THIS METHOD

The invention relates to a method of operating a sewing installation comprising a work piece holder of a geometry that corresponds to the outer contour of the work piece to be fixed thereon, the work piece holder being displaceable relative to a sewing needle via a control unit by the aid of x-y-drive motors, and a storage medium being disposed on the work piece holder; and to a corresponding sewing installation.

A sewing installation of the generic type is known for instance from DE 34 31 061 A1 (corresponding to U.S. Pat. No. 4,548,142). A work piece holder is described to be identified by the aid of a code which is formed by two surface areas which are optically reflecting or non-reflecting, the combination thereof correspondingly offering six possibilities of encoding.

EP 0 269 287 B1 specifies the optical scanning of the configuration of work pieces for the possibility of detection of how the work pieces are oriented, based on a comparison with stored work piece patterns relative to a tool.

DE 32 46 027 T1 (corresponding to U.S. Pat. No. 4,479,446) discloses a sewing machine which allows stitch patterns to be allocated to the work pieces to be sewn. The work pieces are disposed on pallets which have a binary code. Allocation of the stitch patterns takes place by detection of this binary code.

The known work piece encoding systems have in common that tables must be prepared in the control unit on the side of the sewing machine for the generation of sewing patterns, these tables, after identification of the work piece holder based on type, size and configuration, then allowing the preparation of a corresponding sewing program.

It is an object of the invention to embody a method and a sewing installation of the type mentioned at the outset such that the program for processing a certain sewing pattern will be even simpler and can be put into practice independently of data stored on the side of the sewing installation.

According to the invention, this object is attained by a method wherein provision is made for any information necessary for the control of the sewing installation to be stored in a storage medium that is disposed on the work piece holder so that, after this information has been read out, the course of the seam is computed and sewn in the sewing installation, corresponding to the contour of the work piece holder, with a given stitch length being fed into the control unit, and with the computing device of the control unit modifying the given stitch length in dependence on the computed outer contour of the work piece holder for an integral number of stitches to result.

In a sewing installation for putting this method into practice, it is provided that a storage medium is disposed on the work piece holder, comprising the entire information necessary for the control of the sewing installation, in order for the course of the seam to be computed and sewn, corresponding to the contour of the work piece holder, the sewing installation having a sensor unit designed for reading the information out of the storage medium and feeding the information to an input of the sewing-machine control unit, it being possible to input a stitch length in the control unit, with the computing device of the control unit modifying the given stitch length in dependence on the computed outer contour of the work piece holder for an integral number of stitches to result.

In keeping with a further development of the invention, it is provided that the storage medium is a chip. In as much as a chip is mentioned in this context, this refers very generally to an arrangement which enables information to be fed in, stored and read out at least once.

When the size of the work piece holder is modifiable, this is also taken into account in the modification of the stitch length.

By advantage, provision can be made for an input equipment for the manual input of a stitch length. As a rule, the stitch length is also stored on the storage medium and read out automatically. However, situations are conceivable, in which it is desirable, for purposes of modification or correction, to change the stitch length stored on the storage medium. To this end provision is made for the manual input equipment.

By advantage, the sensor unit is disposed underneath the table board, preferably in a recess thereof, in the form of a wire coil as an antenna. This helps contacting the storage medium to be read out in a close, non-contact way, simultaneously ensuring protected accommodation that does not interfere with the sewing job.

The invention differs from the prior art sewing installations and modes of operation in that the encoding applied to the work piece holder allows not only identification thereof and correspondingly the preparation of a seam program in combination with tables stored on the side of the sewing machine, but it ensures that solely the set of data stored on the work piece holder, in particular in a chip, is sufficient, and contains any information necessary, for the desired seam to be sewn regardless of the sewing machine on which the work piece holder is employed. This helps achieve a high degree of simplification of the procedure between the manufacturer of the work piece holder and the operator of the sewing installation, because the chip of the work piece holder is programmable entirely independently of the storage contents of the sewing installation.

Details of the invention will become apparent from the ensuing description of a preferred embodiment, taken in conjunction with the drawing, in which:

FIG. 1 is a diagrammatic illustration of a plan view of a sewing installation according to the invention;

FIG. 2 is an illustration, on an enlarged scale, of the detail II in FIG. 1;

FIG. 3 is a sectional view, on an enlarged scale, on the line III—III in FIG. 2;

FIG. 4 is an illustration of another exemplary embodiment of the work piece;

FIG. 5 is an illustration of a work piece with a continuous seam;

FIG. 6 is an illustration of the work piece of FIG. 5 when turned inside out and provided with a closing seam;

Figure 7:
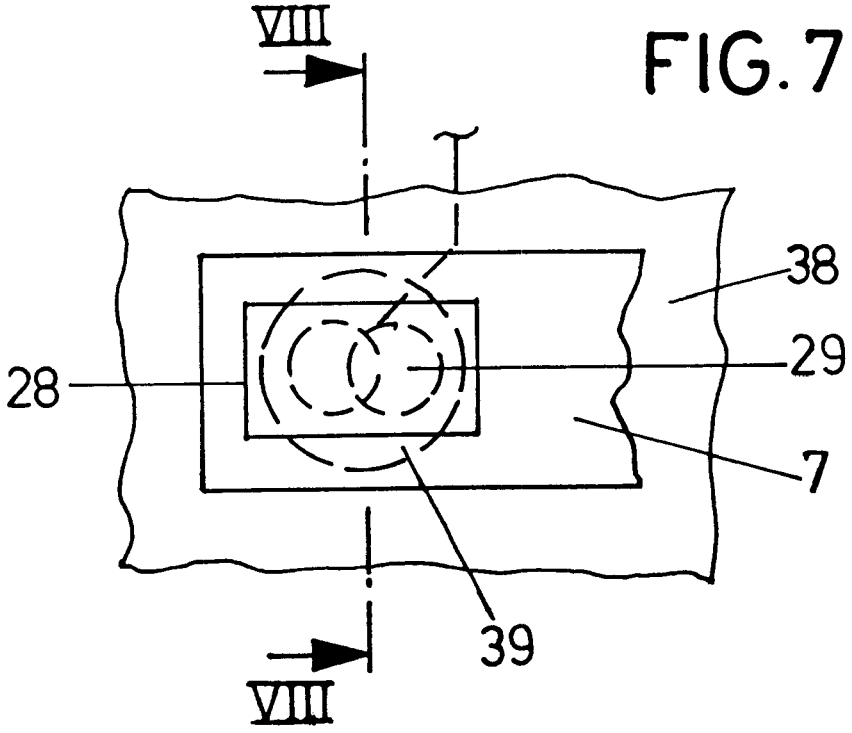
FIG. 7 is a view, on an enlarged scale, of an area of FIG. 1.

FIG. 1 illustrates a work piece in the form of a collar 1 which is to be sewn and consists substantially of a left collar part 2 and a right collar part 3. Between these two collar parts 2, 3 is an adjustable straight part 4, the length of which corresponds to the dimension s. The configuration of the collar 1 is determined by the points A, B, C, D, E, F. In the embodiment, the points A, B, C are mirror-inverted in relation to the points D, E, F. However, it is also possible to work work pieces without a corresponding symmetry line. In the following, it is assumed that the points A to F are sufficient for completely defining the geometry of the collar 1.

The adjustable part 4 is designed in such a way that varying work piece sizes can be set by the parts 2, 3 being displaced one relative to the other in the direction of the x-axis.

The dimension s may range between 0 and 100 mm with a resolution of 1/10 mm.

The collar 1 is fixed on a work piece holder that comprises two halves 5, 6 which are lodged in a support 7. Adjusting the position of the half 6 enables the size of the work piece holder 5, 6, 7, in a manner known per se, to be suited to the collar 1 that is to be sewn. FIG. 1 also illustrates that one half 6 of the work piece holder 5, 6, 7 comprises a marking 8 which serves to activate a read head 29 on the side of the sewing installation to emit a signal corresponding to the adjusted size of the work piece holder 5, 6, 7.

As seen in FIG. 3, the work piece holder 5, 6, 7 comprises a lower plate 9 and an upper plate 10. Attached to the lower plate 9 is a plastic film 11 of approximately 0.5 mm of thickness which reaches as far as to the proximity of the edge of the needle 12, a space t of approximately 0.5 mm being available between the edge portion of the needle 12 and the edge of the film 11. The upper plate 10 comprises a glued on strip of cellular rubber 13.

The work piece i.e., the collar 1, is clamped by frictional engagement. As seen in FIG. 3, the edge of the film 11 supports itself on a projection 14, which is tubular, having a stitch hole for the needle 12 that reciprocates up and down. The projection 14 is fixed on the lower arm 15 of a stationary sewing head 16.

Disposed around the axis 17 of the sewing needle 12 is a cutting device 18, having a movable knife 19 and a stationary knife 20. Owing to the oscillating motions of the knife 19, a finishing cutting job takes place at a distance u from the seam line 21. The cutting job is accompanied with the clamped collar 1 being cut. As seen in FIG. 1, the angular position of the cutting device 18 is triggered by a stepper motor 22, the angle being designated by G.

According to FIG. 2, a change of direction of the seam line 21 takes place at the point B where an acute angle is formed. Correspondingly, it is necessary there to sew a so-called comer stitch. Correct positioning of the corner stitch is essential for the appearance of the finished collar 1.

As seen in FIG. 5, the collar 1 comprises two fabric layers 23, 24, the latter of which being coated with a padding 25. Along the seam line 21, the fabric layers 23 and 24 are sewn together by a continuous seam. After this operation. the collar 1 is turned inside out and then finished by a closing seam 26.

As another example of a course of a seam, FIG. 4 shows a cuff 27, the geometry of which can be defined by the points H, I, K, L and M. The symmetrical circumstances are such that the total size can be adjusted by the straight-line dimension v being modified.

According to FIG. 1, a non-volatile memory chip 28 is disposed on the work piece holder 5, 6, 7, namely on the support 7; it may equally be read out by the read head 29 on the sewing head 16 of the sewing installation. The support 7 with halves 5, 6 of the work piece holder 5, 6, 7 is movable in an x-y-plane, whereas the sewing head 16 is stationary. To this end, the support 7 is joined to a carriage 30 of an x-y-coordinate drive. The generation of the x-and y-motions is implemented by controlled x-and y-motors. Correspondingly, a working area 32 of the needle 12 is given, having the dimensions f and g.

As seen in FIG. 1, the support 7 has an end piece 33. In a position of the support 7 on the extreme left (FIG. 1), the end piece 33 takes the position designated by 34.

The sewing head 16 is actuated by a motor 35. All the four mentioned motors are connected with individual control devices W, Z, X and Y, which are again triggered by a computer-based control unit 36.

The construction described above enables a sewing installation to be supplied with work piece holders 5, 6, 7, there being no need for the work piece holders 5, 6, 7 to have a given arrangement or sequence. Each work piece holder 5, 6, 7 can be equipped with a work piece of varying shape and/or size. Correspondingly, it is possible to employ work piece holders on varying sewing installations without any allocation.

As soon as a work piece holder 5, 6, 7 is installed on a driver (not shown) of the x-y-coordinate drive, the automatic sewing machine automatically begins with a conveying motion of the work piece holder 5, 6, 7 in the direction of the needle 12 i.e., in the direction of the x-axis. As soon as the chip 28 arrives in the reading area of the read head 29, the data stored on the chip 28 are read out. These data may comprise information about points that define the geometry of the work piece and auxiliary information, enabling a downstream control unit 36 to compute the x-y-information of the entire seam contour or, respectively, of a half thereof for reasons of symmetry. Putting this computation into practice requires the control unit 36 to proceed from a certain stitch length which is given by an operator via an input equipment 37. Moreover, the control unit 36 will read out the data for auxiliary functions such as a corner stitch, rounding function, stay stitch, thread cutting function, mirror function and further information for the cutting device 18 etc.

When the sewing head 16 produces the seam, the marking 8 arrives in the reading area of the read head 29 so that the control unit 36 receives information on the currently set dimensions of the work piece holder 5, 6, 7.

Since the dimension s in the case of the collar 1 or the dimension v of the cuff 27 and the resulting stitch length may lead to an odd number of stitches, additional iterative computations are carried out, based on acceptable tolerances in the stitch length, in order for an integral number of stitches to be obtained for the respectively set dimensions. In a subsequent operation, mirror information may be exploited i.e., after computation of the seam course for one work piece half, the corresponding data may simply be mirrored.

Figure 8:
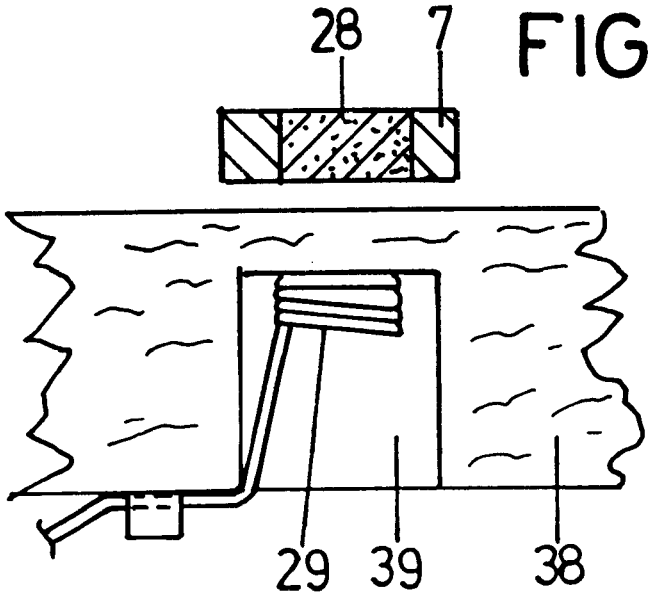
FIG. 8 is a sectional view on the line VIII—VIII of FIG. 7 with the view being rotated counter-clockwise by 90°.

FIG. 7 shows the area of the chip 28 on the work piece holder 7 on an enlarged scale, it being recognizable from the sectional view of FIG. 8 that, underneath the work piece holder 7, the table board 38 has a recess 39 in which is disposed a coil as a sensor unit or a read head 29, respectively.

What is claimed is:

1. A method of operating a sewing installation, comprising a work piece holder of an outer contour that corresponds to the geometry of the work piece to be fixed thereon, the work piece holder being displaceable relative to a sewing needle via a control unit by the aid of x-y-drive motors including the steps of;

storing any information necessary for the control of the sewing installation in a chip storage medium;

reading this information out;

computing and sewing a course of the seam corresponding to the contour of the work piece holder;

feeding a given stitch length into a control unit, and;

modifying the given stitch length with a computing device of the control unit in dependence on a computed outer contour of the work piece holder for an integral number of stitches to result.

2. A method of operating a sewing installation according to claim 1 further comprising the step of detecting and taking into account the size of the work piece holder upon modification of the stitch length.

3. A sewing installation comprising a work piece holder of an outer contour that corresponds to the geometry of the work piece to be fixed thereon, the work piece holder being displaceable relative to a sewing needle via a control unit by the aid of x-y-drive motors, and a storage medium being disposed on the work piece holder comprising;

a chip storage medium that stores any information necessary for the control of the sewing installation so as to compute and sew the course of the seam. corresponding to the contour of the work piece holder and a given stitch length;

the sewing installation having a read head sensor unit designed for reading the information out of the storage medium and feeding the information to an input of the control unit, it being possible, via a chip storage medium and/or input equipment to input a stitch length in the control unit, with the computing device of the control unit modifying the given stitch length in dependence on a computed outer contour of the work piece holder for an integral number of stitches to result.

4. A sewing installation according to claim 3, characterized in that the storage medium is a chip.

5. A sewing installation according to claim 3, characterized in that an input equipment is provided for the manual input of a stitch length.

6. A sewing installation according to claim 3, characterized in that, with the dimensions of the work piece holder being modifiable, the set dimensions are detected and taken into account upon modification of the stitch length.

7. A sewing installation according to claim 3, characterized in that the read head sensor unit is disposed underneath the table board.

8. A sewing installation according to claim 3, characterized in that the read head sensor unit is disposed in the form of a wire coil as an antenna in a recess underneath the table board.

* * * * *